United States Patent [19]

Kaszczuk

[11] Patent Number: 5,055,444

[45] Date of Patent: Oct. 8, 1991

[54] INTERMEDIATE RECEIVER SUBBING LAYER FOR THERMAL DYE TRANSFER

[75] Inventor: Linda A. Kaszczuk, Rochester, N.Y.

[73] Assignee: Eastman Kodak Company, Rochester, N.Y.

[21] Appl. No.: 519,610

[22] Filed: May 4, 1990

[51] Int. Cl.[5] ..... B41M 5/035; B41M 5/26

[52] U.S. Cl. ..... 503/227; 8/471; 428/195; 428/211; 428/412; 428/501; 428/520; 428/913; 428/914

[58] Field of Search ..... 8/471; 428/195, 211, 428/412, 501, 520, 913, 914; 503/227

[56] References Cited

U.S. PATENT DOCUMENTS 4,923,848 5/1990 Akada et al. ..... 503/227
4,965,239 10/1990 Henzel ..... 503/227

FOREIGN PATENT DOCUMENTS 60-203494 10/1985 Japan ..... 503/227
62-66997 3/1987 Japan ..... 503/227

*Primary Examiner*—Bruce H. Hess

*Attorney, Agent, or Firm*—Andrew J. Anderson

[57] ABSTRACT

An intermediate dye image-receiving element for thermal dye transfer comprising a support having thereon a separable polyolefin layer, a dye image-receiving layer, and a subbing layer between the polyolefin layer and the dye image-receiving layer, wherein the subbing layer comprises a crosslinked poly(vinyl acetal-co-vinyl alcohol). The intermediate receiver is used in a process for formation of a dye image in an arbitrarily shaped object which includes the following steps: (a) forming a dye transfer image by thermal dye transfer in a dye image-receiving layer of an intermediate dye receiving element comprising the dye image-receiving layer, subbing layer, polyolefin layer, and support, (b) separating the imaged dye image-receiving layer from the support, (c) placing the separated, imaged, dye image-receiving layer in contact with an arbitrarily shaped final receiver, (d) transferring the dye image out of the dye image-receiving layer and into the final receiver by the action of heat, and (e) removing the dye image-receiving layer from the imaged final receiver resulting from step (d).

20 Claims, No Drawings

INTERMEDIATE RECEIVER SUBBING LAYER FOR THERMAL DYE TRANSFER

CROSS REFERENCE TO RELATED APPLICATIONS

This application is related to concurrently filed co-pending, commonly assigned U.S. Ser. No. 07/519,603, of Kaszczuk and Mruk entitled "Process for Thermal Dye Transfer to Arbitrarily Shaped Receiver."

TECHNICAL FIELD

This invention relates to a subbing layer for thermal dye transfer receivers, and more particularly to the use of a subbing layer in an intermediate receiver for use in a process for thermal dye transfer to arbitrarily shaped final receivers.

BACKGROUND

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Thermal dye transfer as described above is a well-established procedure for production of an image in a polymeric receiver sheet. There are certain physical requirements, some quite severe, relative to thickness, flatness, flexibility, and shape of such receivers when used in thermal head, laser, flash, or other thermal printing devices. Such restrictions limit the applicability of thermal dye transfer to non-planar objects. It would be desirable to have a process whereby an image generated by a thermal printing device could be formed on an object with few, if any, restrictions of thickness, flatness, shape and flexibility.

Japanese Kokais 62-66997 (Nitto Electric Ind. Co. LTD) and 60-203494 (Ricoh K.K.) disclose forming images in a transparent receiver by thermal dye transfer and then adhering the receiver to an object/mount. This makes possible forming thermal dye transfer images on a wider variety of objects than direct thermal dye transfer to the object, but the presence of an adhered receiver is objectionable in that it results in a raised surface appearance.

EP 0 266 430 (Dai Nippon Insatsu K. K.) discloses a process for formation of a dye transfer image on an arbitrary object comprising forming an image in a dye-receiving layer of a transferrable sheet, separating the dye image-receiving layer from its support, and adhering the dye image-receiving layer to the arbitrary object. By separating the image-receiving layer from its support, a thinner receiver is adhered to the object. While this approach may reduce objections to a raised surface appearance due to the adhered layer, there is still the problem of adhering the image containing layer permanently to the object.

Co-pending, commonly assigned U.S. Ser. No. 07/519,603 referred to above of Kaszczuk and Mruk, the disclosure of which is hereby incorporated by reference, discloses a process whereby a thermal dye transfer image can be formed on an object of arbitrary shape without having to permanently adhere a separate layer to such objects. This process requires use of an intermediate dye-receiving element comprising a support and a seperable dye image-receiving layer. After an image is formed in the dye image-receiving layer by conventional means, the imaged intermediate receiving layer is separated from the support and placed in contact with an arbitrarily shaped final receiver. The dye image is then retransferred out of the intermediate receiving layer and into the final receiver by the action of heat.

A preferred intermediate receiving element disclosed in Ser. No. 07/519,603 comprises a paper support, an unsubbed polyolefin layer extrusion coated on the paper support, and a dye image-receiving layer coated on the polyolefin layer. The polyolefin layer's moderate adhesion to the support allows for support removal from the remaining layers of the intermediate receiving element, and the polyolefin layer also provides adequate strength and dimensional stability for the remaining layers during the dye retransfer step to the final receiver.

When a paper stock overcoated with a polyolefin layer is used as the support for an intermediate receiver as described above, it is important that a strong bond be established between the polyolefin layer and the adjacent dye-receiving layer. If this bond is weak, the dye image-receiving layer may separate from the polyolefin layer itself when the paper support is to be stripped at the polyolefin interface and it may not be possible to have an integral sheet of sufficient cohesiveness suitable for retransfer. There is thus a need for a strong bonding subbing layer at the polyolefin interface.

Subbing layers of the prior art are not satisfactory for this purpose. Polyvinylidene chloride derived materials have been used as dye receiver subbing layers (U.S. Pat. No. 4,748,150) but form too weak a bond for the present use. Metal alkoxide (such as titanium tetra-n-butoxide) and alkoxysilane derived polymers are generally more effective subbing layers, but these materials are subject to hydrolysis and are thus difficult to coat in a reproducible manner.

It would be desirable to provide an intermediate dye-receiving element which would have sufficient adhesion between a polymeric dye image-receiving layer and a polyolefin layer coated on a support such that the support could be removed from the polyolefin and dye image-receiving layers while retaining the polyolefin and dye image-receiving layers together as a cohesive unit.

SUMMARY OF THE INVENTION

These and other objects of the invention are achieved in accordance with this invention which comprises an intermediate dye image-receiving element for thermal dye transfer comprising a support having thereon a separable polyolefin layer, a dye image-receiving layer, and a subbing layer between the polyolefin layer and the dye image-receiving layer, wherein the subbing layer comprises a crosslinked poly(vinyl acetal-co-vinyl alcohol).

DETAILED DESCRIPTION

Several details are critical for all of the steps of the above described retransfer process to function effectively. The dyes must transfer efficiently to the intermediate receiver but must not be held so strongly that they cannot be efficiently retransferred to the final receiver. The first separating of the support from the remainder of the intermediate receiver requires a weak bond for clean separation. All of the remaining portions of the intermediate receiver, however, must be strongly bonded together and have good cohesive strength so that they may be carried as a unit and placed in a smoothed manner over a variety of surfaces (curved, irregular or flat) used for the final receiver. The contact of the intermediate receiver to the final receiver must be such that it does not slide, slip, or undergo differential expansion during the retransfer step. After the retransfer step there must be easy and complete removal of the remaining layers of the intermediate receiver from the final receiver so as to only leave a fused dye image in the final receiver.

The intermediate dye-receiving element of the invention comprises a support having thereon a separable polyolefin layer, a dye image-receiving layer, and a subbing layer between the polyolefin layer and the dye image-receiving layer. The dye image-receiving layer of the intermediate receiving element of the invention may comprise, for example, a polycarbonate, a polycaprolactone, or a linear polyester of an aliphatic diol with either an aromatic or aliphatic dicarboxylic acid. Other receiver polymers are also well known in the art, and copolymers, or polymer blends may also be used either as a single layer or with a protective overcoat or a second receiver overcoat. In a preferred embodiment, the intermediate dye-receiving element includes a polycaprolactone receiver overcoat. The intermediate dye image-receiving layer polymer must be chosen with a balance of dye-affinity and lack of permanent adhesion to the final receiver. The dye image-receiving layer may be present in any amount which is effective for the intended purpose. In general, good results have been obtained at a concentration of from about 0.5 to about 5 $g/m^2$.

In a preferred embodiment of the invention, the dye image-receiving layer of the intermediate receiver includes a polycarbonate. The term "polycarbonate" as used herein means a polyester of carbonic acid and a glycol or a dihydric phenol. Examples of such glycols or dihydric phenols are p-xylylene glycol, 2,2-bis(4-oxyphenyl)propane, bis(4-oxyphenyl)methane, 1,1-bis(4-oxyphenyl)ethane, 1,1-bis(oxyphenyl)butane, 1,1-bis(oxyphenyl)cyclohexane, 2,2-bis(oxyphenyl)butane, etc. In a particularly preferred embodiment, a bisphenol-A polycarbonate having a number average molecular weight of at least about 25,000 is used. Examples of preferred polycarbonates include General Electric LEXAN ® Polycarbonate Resin and Bayer AG MACROLON 5700 ®.

The purpose of the support for the intermediate dye-receiver is to provide adequate strength, dimensional stability, and insulating effect during the image transfer to the intermediate receiver to enable a high quality image to be transferred. Any material which provides these qualities and is also relatively easily separable from a polyolefin layer may be used. For producing moderate adhesion to permit support removal from the receiver layer, use of an unsubbed polyolefin layer extrusion overcoated on a cellulose based paper stock is preferred for the intermediate receiver. Polypropylene or polypropylene derived layers are especially preferred because their higher cohesive strength makes them less likely to tear. Copolymers of polyolefins may also be used. Blends of polypropylene with polyethylene are especially favored. This polyolefin layer provides adequate strength and dimensional stability for the dye retransfer step to the final receiver, enabling the bulk of the intermediate receiver, i.e. the support, to be removed after it has served its purpose during the initial dye transfer step to the intermediate dye image-receiving layer. With the support removed, the remaining layers are more flexible and conform better to the shape of the final receiver, enabling a higher quality image to be formed in the final receiver upon retransfer.

The poly(vinyl acetal-co-vinyl alcohol) component of the crosslinked subbing layer of the invention has the following structure:

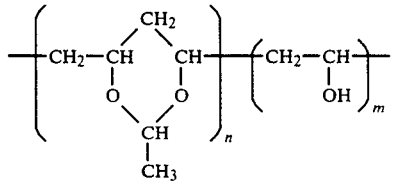

wherein n is preferably about 90 to 60 mole %, most preferably 80 to 70%, and m is preferably about 10 to 40 mole %, most preferably 20 to 30%. Molecular weight is not critical.

The vinyl alcohol portion of the polymer is conveniently cross-linked with a dialdehyde to form internal hemiacetal linkages. Other cross-linking agents include diisocyanates, epoxides, and dihydric phenols. These cross-linking reactions are known in the art and are described in "Butvar Properties and Uses," Tech. Bulletin 8084, p.17ff, Monsanto Co., St. Louis (1989), the disclosure of which is incorporated by reference. Cross-linking is initiated by an acid catalyst and is preferably allowed to go substantially to completion. Cross-linking is conveniently carried out during the subbing layer coating operation at temperatures from 65° C. to 20° C. for contact times of 1 to 5 min., although sometimes crosslinking will occur at room temperature or may proceed with relatively greater difficulty.

The coating coverage of the cross-linked polyvinylacetal subbing layer is preferably 0.02 to 0.6 $g/m^2$, most preferably 0.05 to 0.2 $g/m^2$.

A variety of polymers may be used as the final receiver. These materials appear to have no common chemical structure or physical property requirement and may be quite diverse. Examples of preferred polymers for final receivers include polyimides, polyarylates, polyacetals, polyolefins, polycarbonates, polyethersulfones, and polyetherketones.

The time and duration of heating necessary to transfer the dye image from the intermediate to the final receiver may range from 1.0 to 3.0 min. at 160° to 220°

C. Good results have been obtained at 205° C. for two minutes.

A dye-donor element that is used with the intermediate dye-receiving element of the invention comprises a support having thereon a dye containing layer. Dyes known to be suitable for thermal dye-transfer are considered useful for this process; these would include preformed dyes without restriction that absorb in the visible light spectrum and could include infrared and ultraviolet light absorbing materials. Two component dye-formation systems are also considered practical for this process. Examples of suitable dyes include anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

(magenta)

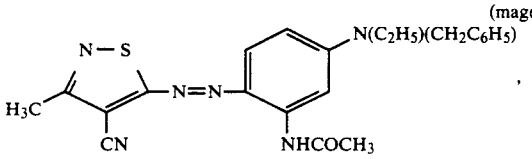

(yellow)

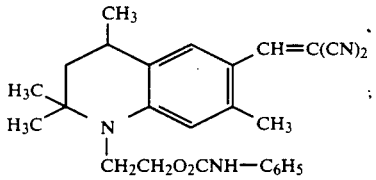

(cyan)

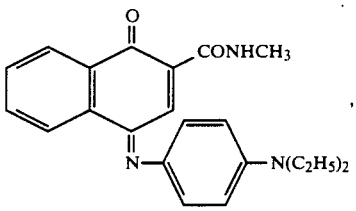

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogenphthatate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

The reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of from about 0.001 to about 2 g/m$^2$. If a polymeric binder is employed, the lubricating material is present in the range of 0.1 to 50 weight %, preferable 0.5 to 40, of the polymeric binder employed.

As noted above, the dye-donor elements are used to form a dye transfer image in the intermediate dye image-receiving elements of the invention. Such a process comprises imagewise-heating a dye-donor element as described above and transferring a dye image to the intermediate dye-receiving element to form the dye transfer image.

Transfer of the dyes from the dye-donor is preferably done by means of a thermal head although other heating means may be used such as laser, light-flash, or ultrasonic means. Some of these techniques would require modification of the dye-donor to include a means of converting the input energy to heat as is well-known in the art.

The dye-donor element may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two-three- or four-color elements (or higher numbers also) are included within the scope of the invention.

In a preferred embodiment, the dye-donor element comprises a poly(ethylene terephthalate) support coated with sequential repeating areas of cyan, magenta and yellow dye, and the above process steps are sequentially performed for each color to obtain a three-color dye transfer image in the intermediate dye-receiving element. Of course, when the process is only performed for a single color, then a monochrome dye transfer image is obtained.

Thermal printing heads which can be used to transfer dye from the dye-donor elements to the intermediate receiving elements are available commercially. There can be employed, for example, a Fujitsu Thermal Head (FTP-040 MCS001), a TDK Thermal Head F415 HH7-1089 or a Rohm Thermal Head KE 2008-F3.

The following examples are provided to illustrate the invention.

EXAMPLES

Preparation of poly(vinyl acetal-co-vinyl alcohol)

Poly(vinyl acetal-co-vinyl alcohol) is conveniently prepared by accepted procedures described in the Kirk-Othmer "Encyclopedia of Chemical Technology", Vol. 3, p. 801 and "Textbook of Polymer Science," J. Billmeyer, ed., 2nd Ed., pp. 418–419, the disclosures of which are incorporated by reference.

Polyvinyl alcohol (du Pont Vinol 325) (440 g) was added to distilled water (5580 g) and was heated to 90° C. for one hour to give a clear solution. The solution was cooled to 10° C., 36% hydrochloric acid (1300 g) was added and cooling was continued at 10° C. Acetaldehyde (274 g) was added with vigorous stirring at 10° C. for 10 minutes, the mixture became milky and a finely divided precipitate formed. Stirring was continued for an additional 15 minutes at 10° C., the temperature was raised to 30° C. and stirring was continued for four hours. The finely divided solid was filtered, washed twice for 30 minutes with distilled water (4000 mL), and washed a third time with the water adjusted initially and repeatedly with sodium hydroxide until a pH of 7 was maintained. The solid was filtered and dried in a vacuum oven at 40° C. The yield was 508 g solid.

Preparation of dye-donors

Dye-donors were prepared by coating on one side of a 6 μm poly(ethylene terephthalate) support 1) a subbing layer of duPont Tyzor TBT® titanium tetra-n-butoxide (0.12 g/m$^2$) from a n-propylacetate and 1-butanol solvent mixture; and
2) a layer containing the magenta dye

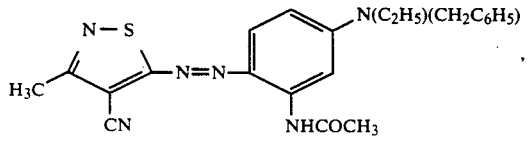

(0.23 g/m$^2$)

and Shamrock Technologies, Inc. S-363® (a micronized blend of polyethylene, polypropylene, and oxidized polyethylene particles)(0.02 g/m$^2$) in a cellulose acetate propionate binder (2.5% acetyl, 45% propionyl) (0.47 g/m$^2$) coated from a toluene, methanol, and cyclopentanone solvent mixture.

On the reverse side of each dye-donor, a backing (slipping layer) of Acheson Colloids Emralon 329® (a dry-film lubricant of polytetrafluoroethylene particles in cellulose nitrate) (0.54 g/m$^2$) and Shamrock Technologies S-Nauba 5021® (predominately Carnauba wax) (0.02 g/m$^2$) was coated from an n-propyl acetate, toluene, 2-propanol and 1-butanol solvent mixture.

Preparation of Intermediate Dye-Receivers

Intermediate dye-receivers were prepared on a paper stock of 7 mil (172 microns) thickness mixture of hardwood and softwood sulfite-bleached pulp. The stock was extrusion overcoated (by methods well-known in the art) with a blend of 20% polyethylene and 80% polypropylene (37 g/m$^2$). On top of the polyolefin layer, a layer of the invention or control subbing layers was coated. Coating conditions of 71° C. and two minutes contact time were sufficient to generate crosslinking of the acetal polymer in the layer.

On top of the subbing layer, a dye-receiving layer of Bayer AG Makrolon 5700® (a bisphenol-A polycarbonate) (2.9 g/m$^2$), Union Carbide Tone PCL-300® (polycaprolactone) (0.38 g/m$^2$) and 1,4-didecoxy-2,5-dimethoxybenzene (0.38 g/m$^2$) was coated from a dichloromethane and trichloroethylene solvent mixture. On top of this layer a receiver overcoat layer of Union Carbide Tone PCL-300® (0.11 g/m$^2$), Dow Corning DC510® Silicone Fluid (0.01 g/m$^2$), and 3M Corp. Fluorad FC-431® (0.01 g/m$^2$) was coated from a dichloromethane and trichloroethylene solvent mixture.

The following subbing layers of the invention were coated:

E-1 Poly(vinyl acetal-co-vinyl alcohol) (73% acetal) (0.11 g/m$^2$), glyoxal (0.026 g/m$^2$), and p-toluenesulfonic acid (0.007 g/m$^2$) dissolved as a mixture in butanone for coating E-2 Poly(vinyl acetal-co-vinyl alcohol) (73% acetal) (0.11 g/m$^2$) and Mobay Chemical Mondur CB-75 (a toluenediisocyanate based adduct) (0.022 g/m$^2$) coated from butanone The following control subbing layers were coated:

C-1 No subbing layer between the polyolefin layer and the dye-receiving layer

C-2 Poly(acrylonitrile-co-vinylidene chloride-co-acrylic acid) (14:80:6 wt. ratio) (0.075 g/m$^2$) coated from a dichloromethane and trichloroethylene solvent mixture C-3 duPont Tyzor TBT® (titanium tetra-n-butoxide) (0.12 g/m$^2$) coated from 1-butanol C-4 Dow Corning Z-6020 (N-(β-aminoethyl)-γ-aminopropyltrimethoxysilane) (0.27 g/m$^2$) coated from an ethanol and water solvent mixture

Evaluation of subbing layers

The dye-side of a dye-donor element strip approximately 10 cm × 13 cm in area was placed in contact with the polymeric image-receiver layer side of an intermediate dye-receiver element of the same area. This assemblage was clamped to a stepper-motor driven 60 mm diameter rubber roller. A TDK Thermal Head L-231 (thermostatted at 22° C.) was pressed with a force of 3.6 kg against the dye-donor element side of the contacted pair pushing it against the rubber roller.

The imaging electronics were activated causing the donor-receiver assemblage to be drawn through the printing head/roller nip at 6.9 mm/second. Coincidentally, the resistive elements in the thermal print head were pulsed for 29 usec/pulse at 128 usec intervals during the 33 msec/dot printing time. A maximum density image was generated with 255 pulses/dot. The voltage supplied to the printing head was approximately 23.5 volts, resulting in an instantaneous peak power of 1.3 watts/dot and maximum total energy of 9.6 mJoules/dot. A maximum density of approximately 2.0 to 2.1 Status A Green reflection density of area approximately 1.5 cm$^2$ was produced on the intermediate receiver.

After formation of the image, the paper support was separated from the polyolefin interface of the intermediate receiver and discarded. The relative difficulty of this separation and effectiveness without tearing was observed and is tabulated below as "First Peel."

The remainder of the imaged intermediate receiver (polyolefin layer, acetal or control subbing layer, receiver layer, and receiver overcoat layer) was placed as a unit (receiver overcoat side down) on top of a final receiver. Three final receivers consisting of sheets of extruded polymer 2 mm thick were used.

1) Polyether sulfone (ICI Corp.) "PES" (a polyether sulfone derived from 4-hydroxyphenyl sulfone and hydroquinone)
2) LEXAN 141 ® (General Electric Corp.) (a polycarbonate derived from bisphenol-A)
3) Polyetherether ketone (ICI Corp.) "PEEK" (a copolymer of p,p'-dihydroxybenzophenone and hydroquinone)

After light pressure was applied to remove wrinkles and give intimate contact between the two receivers, the assemblage was heated using a platen for 2 minutes at 205° C. to uniformly transfer the imaged dye from the intermediate receiver and fuse it within the final receiver polymer. The intermediate receiver layers were then removed as a unit from the final receiver and discarded. The relative difficulty of this separation and effectiveness without leaving residual receiver polymer from the intermediate receiver on the final receiver was observed and is tabulated below as "Second Peel."

| | | Second Peel | | |
|---|---|---|---|---|
| Subbing Layer | First Peel | "PES" Polymer | LEXAN Polymer | "PEEK" Polymer |
| E-1 (Acetal with glyoxal) | Clean | Effective | Effective | Effective |
| E-2 (Acetal with diisocyanate) | Clean | Effective | Effective | Effective |
| C-1 (Control - no subbing) | Fails | ND | ND | ND |
| C-2 (Acrylonitrile polymer) | Fails | ND | ND | ND |
| C-3 (Titanium alkoxide) | Fails | ND | ND | ND |
| C-4 (Alkoxysilane) | Clean | Fragmented | Fragmented | Effective |

Clean: clean and easy separation at polyolefin to paper support interface; polyolefin remains affixed to receiver as a coherent unit for retransfer (i.e. polyolefin to sub to receiver bond is strong)
Fails: receiver not retained with polyolefin as a coherent unit, thus efficient retransfer is not practical
ND: retransfer not determinable because of failure at first peel
Effective: intermediate receiver is cleanly removed from final receiver leaving only a dye image on the final receiver
Fragmented: intermediate receiver remains partially or substantially on final receiver The data above shows that the cross-linked poly(vinyl acetal-co-vinyl alcohol) subbing layer of the invention is superior to prior art subbing layers for this retransfer process. This superior performance is shown with three different final receiver polymers.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having thereon a separable polyolefin layer, a dye image-receiving layer, and a subbing layer between the polyolefin layer and the dye image-receiving layer, wherein the subbing layer comprises a crosslinked poly(vinyl acetal-covinyl alcohol).

2. The element of claim 1 wherein the support comprises a cellulose based paper support and the polyolefin layer is extrusion coated thereon.

3. The element of claim 2 wherein the polyolefin layer comprises polypropylene.

4. The element of claim 1 wherein the dye image-receiving layer comprises a polycarbonate.

5. The element of claim 1 further comprising a receiver overcoat layer comprising polycaprolactone coated on the dye image-receiving layer.

6. The element of claim 1 wherein the poly(vinyl acetal-co-vinyl alcohol) before cross-linking comprises

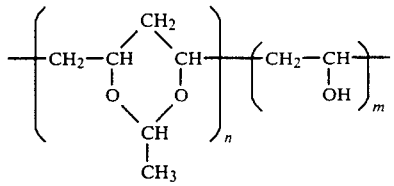

wherein n is about 90 to 60 mole %, and m is about 10 to 40 mole%.

7. The element of claim 6 wherein n is about 80 to 70 mole % and m is about 20 to 30 mole %.

8. The element of claim 6 wherein the poly(vinyl acetal-co-vinyl alcohol) is cross-linked with a dialdehyde, a diisocyanate, an epoxide, or a dihydric phenol.

9. The element of claim 8 wherein the poly(vinyl acetal-co-vinyl alcohol) is cross-linked with a dialdehyde.

10. The element of claim 8 wherein the poly(vinyl acetal-co-vinyl alcohol) is cross-linked with a diisocyanate.

11. A process for formation of a dye image in an arbitrarily shaped object comprising:

(a) forming a dye transfer image by thermal dye transfer is a dye image-receiving layer of an intermediate dye-receiving element comprising a support having thereon a separable polyolefin layer, the dye image-receiving layer, and a subbing layer between the polyolefin layer and the dye image-receiving layer, wherein the subbing layer comprises a crosslinked poly(vinyl acetal-co-vinyl alcohol).
(b) separating the imaged dye image-receiving layer from the support,
(c) placing the separated, imaged, dye image-receiving layer in contact with an arbitrarily shaped final receiver,
(d) retransferring the dye image out of the dye image-receiving layer and into the final receiver by the action of heat, and
(e) removing the dye image-receiving layer from the imaged final receiver resulting from step (d).

12. The process of claim 11 wherein the intermediate dye-receiving element support comprises a cellulose based paper support and the polyolefin layer is extrusion coated thereon.

13. The process of claim 12 wherein the polyolefin layer comprises polypropylene.

14. The process of claim 11 wherein the intermediate dye image-receiving layer comprises a polycarbonate.

15. The process of claim 11 wherein the intermediate dye-receiving element further comprises a receiver overcoat layer comprising polycaprolactone coated on the dye image-receiving layer.

16. The process of claim 11 wherein the poly(vinyl acetal-co-vinyl alcohol) before cross-linking comprises

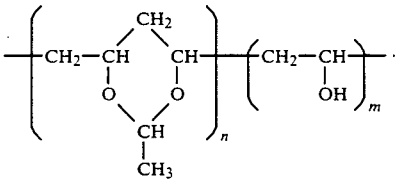

wherein n is about 90 to 60 mole %, and m is about 10 to 40 mole %.

17. The process of claim 16 wherein n is about 80 to 70 mole % and m is about 20 to 30 mole %.

18. The process of claim 16 wherein the poly(vinyl acetal-co-vinyl alcohol) is cross-linked with a dialdehyde, a diisocyanate, an epoxide, or a dihydric phenol.

19. The process of claim 18 wherein the poly(vinyl acetal-co-vinyl alcohol) is cross-linkd with a dialdehyde.

20. The process of claim 18 wherein the poly(vinyl acetal-co-vinyl alcohol) is cross-linked with a diisocyanate.

* * * * *